US008157089B2

(12) United States Patent
Shiao

(10) Patent No.: US 8,157,089 B2
(45) Date of Patent: Apr. 17, 2012

(54) HEIGHT ADJUSTABLE TOP FRAME FOR GOLF BAG

(76) Inventor: Kun-Lin Shiao, Yangmei Chen (TW)

( * ) Notice: Subject to any disclaimer, the term of this patent is extended or adjusted under 35 U.S.C. 154(b) by 440 days.

(21) Appl. No.: 12/553,783

(22) Filed: Sep. 3, 2009

(65) Prior Publication Data

US 2011/0048985 A1 Mar. 3, 2011

(51) Int. Cl.
*B65D 55/00* (2006.01)

(52) U.S. Cl. ..... 206/315.6; 211/70.2

(58) Field of Classification Search ..... 206/315.6, 206/315.3; 211/70.2
See application file for complete search history.

(56) References Cited

U.S. PATENT DOCUMENTS

| | | | | |
|---|---|---|---|---|
| 2,752,973 | A * | 7/1956 | Stamp | 206/315.6 |
| 5,103,974 | A * | 4/1992 | Antonious | 206/315.6 |
| 5,853,086 | A * | 12/1998 | Chang | 206/315.6 |
| 6,105,792 | A * | 8/2000 | Chang | 211/70.2 |
| 7,025,202 | B2 * | 4/2006 | Jansen et al. | 206/315.3 |
| 7,124,899 | B1 * | 10/2006 | Wright | 211/70.2 |

* cited by examiner

*Primary Examiner* — Tri Mai
(74) *Attorney, Agent, or Firm* — C. G. Mersereau; Nikolai & Mersereau, P.A.

(57) ABSTRACT

A height adjustable top frame for a golf bag has a base, at least one locking rod mounted slidably through the base, a holding bracket mounted securely on an upper end of the at least one locking rod and a locking mechanism mounted between the base and the holding bracket and selectively engaging the at least one locking rod. Despite being different lengths, golf clubs can be supported by adjusting the holding bracket to allow heads of the golf clubs to rest on the holding bracket. The golf bag with the height adjustable top frame does not have to be lengthened and the golf clubs with different lengths are appropriately and stably mounted in the golf bag without colliding or damaging each other.

8 Claims, 8 Drawing Sheets

HEIGHT ADJUSTABLE TOP FRAME FOR GOLF BAG

BACKGROUND OF THE INVENTION

1. Field of the Invention

The present invention relates to a height adjustable top frame for a golf bag, especially to a top frame that is mounted on a golf bag and separately holding heads of golf clubs at different levels to facilitate access to the golf clubs.

2. Description of the Prior Art(s)

Golf clubs such as wood clubs, iron clubs and putters are generally longer than conventional golf bags so a head of the golf club protrudes out of the golf bag to facilitate removal. Generally, competition rules dictate that a maximum of fourteen clubs may be carried and used and selected from wood clubs, iron clubs and putter. However, shafts of different kinds of golf clubs have different lengths. A conventional golf bag stands about 86 to 89 cm to be suitable for shorter golf clubs (ex: putters) and has a conventional top frame holding the shafts of the golf clubs. Thus, the heads of other longer golf clubs (ex: wood clubs or iron clubs) are exposed beyond the top frame or shorter golf clubs are suspended from the top frame. Therefore, when carrying or moving the golf bag, the heads and shafts of the golf clubs may collide and damage each other. In particular, since the iron clubs are not covered with covers, the other golf clubs may be damaged by the iron clubs.

To prevent collision between the golf clubs, another conventional golf bags heighten their top frames by lengthening the golf bag or the top frame or by allowing the golf bag to be extensible. However, with the lengthening of the golf bag or the top frame, the volume and the manufacturing cost of the conventional golf bag are increased. Consequently, the conventional golf bag is expensive, heavy and inconvenient for carrying.

To overcome the shortcomings, the present invention provides a height adjustable top frame for a golf bag to mitigate or obviate the aforementioned problems.

SUMMARY OF THE INVENTION

The main objective of the present invention is to provide a height adjustable top frame for a golf bag.

The height adjustable top frame has a base, at least one locking rod mounted slidably through the base, a holding bracket mounted securely on an upper end of the at least one locking rod and a locking mechanism mounted between the base and the holding bracket and selectively engaging the at least one locking rod.

Despite being different lengths, golf clubs can be supported by adjusting the holding bracket to allow heads of the golf clubs to rest on the holding bracket. The golf bag with the height adjustable top frame does not have to be lengthened and the golf clubs with different lengths are appropriately and stably mounted in the golf bag without colliding or damaging each other.

Other objectives, advantages and novel features of the invention will become more apparent from the following detailed description when taken in conjunction with the accompanying drawings.

DETAILED DESCRIPTION OF THE PREFERRED EMBODIMENTS

With reference to FIGS. 1, 2 and 6 and 7, a height adjustable top frame for a golf bag in accordance with the present invention is mounted on a top of the golf bag (80) and holds heads (71) of golf clubs (70), such as wood clubs (70A), iron clubs (70B) and putters (70C), in the golf bag (80) to prevent the heads (71) from colliding or damaging each other.

Figure 1:
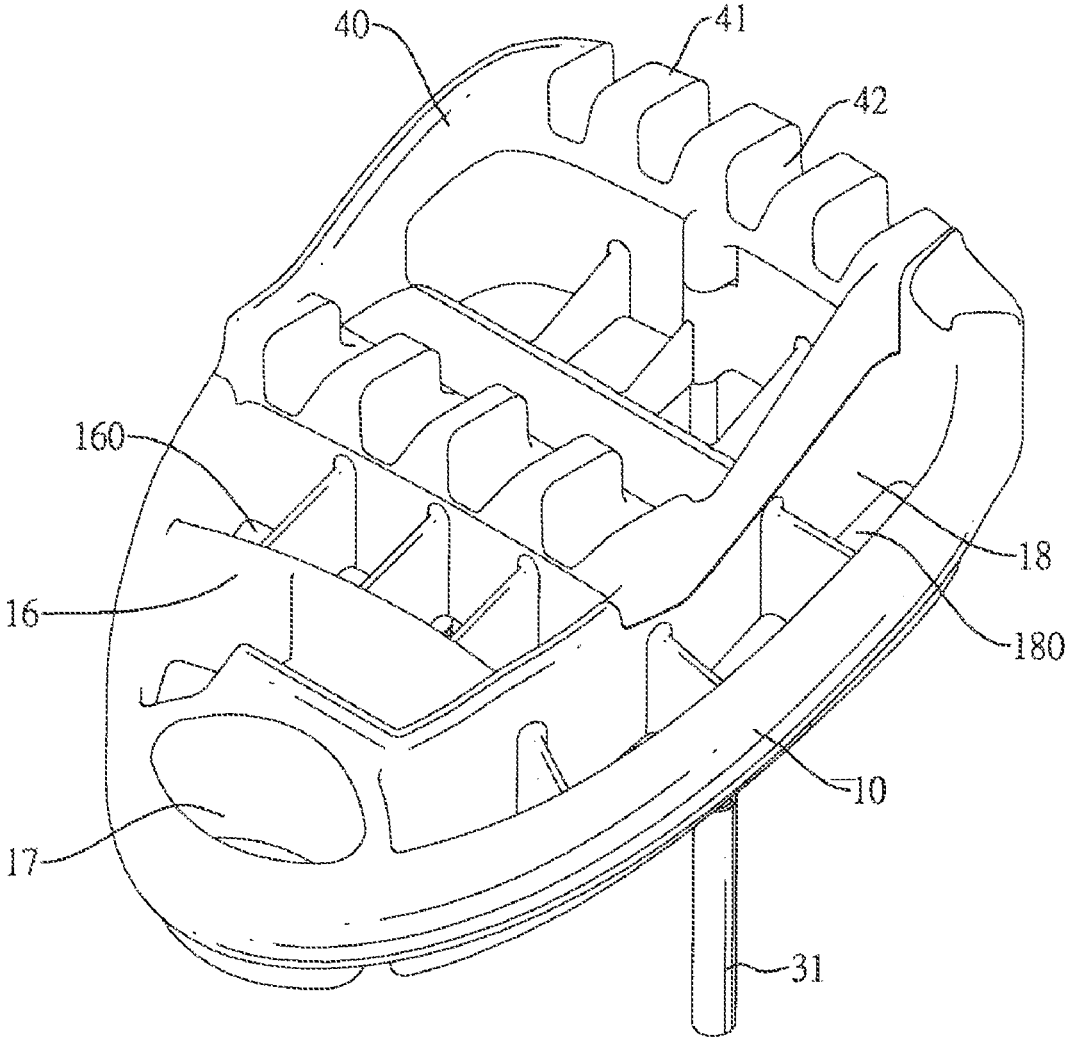
FIG. 1 is a perspective view of a height adjustable top frame for a golf bag in accordance with the present invention.
Figure 2:
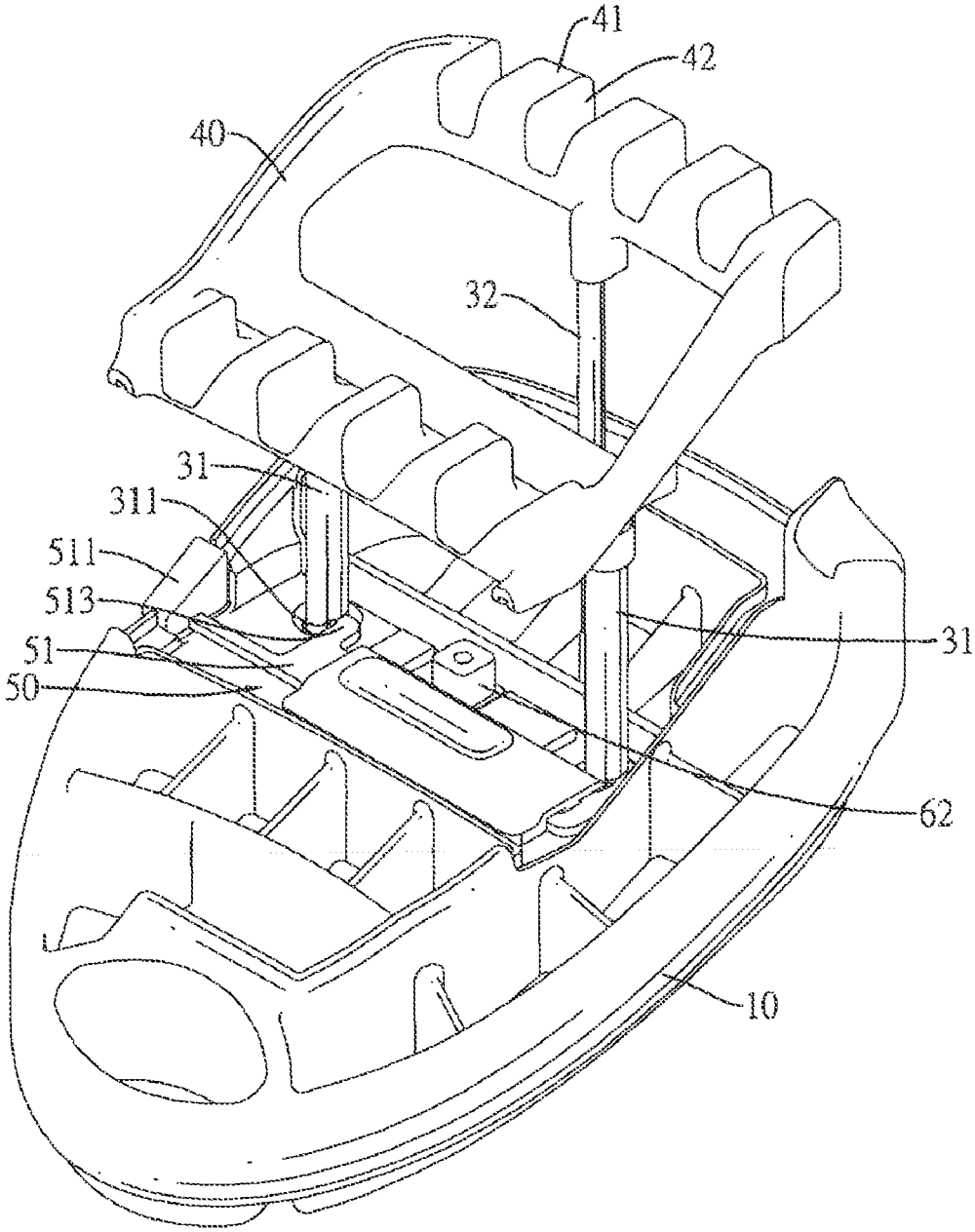
FIG. 2 is an operational perspective view of the height adjustable top frame in FIG. 1, a holding bracket shown raised.
Figure 3:
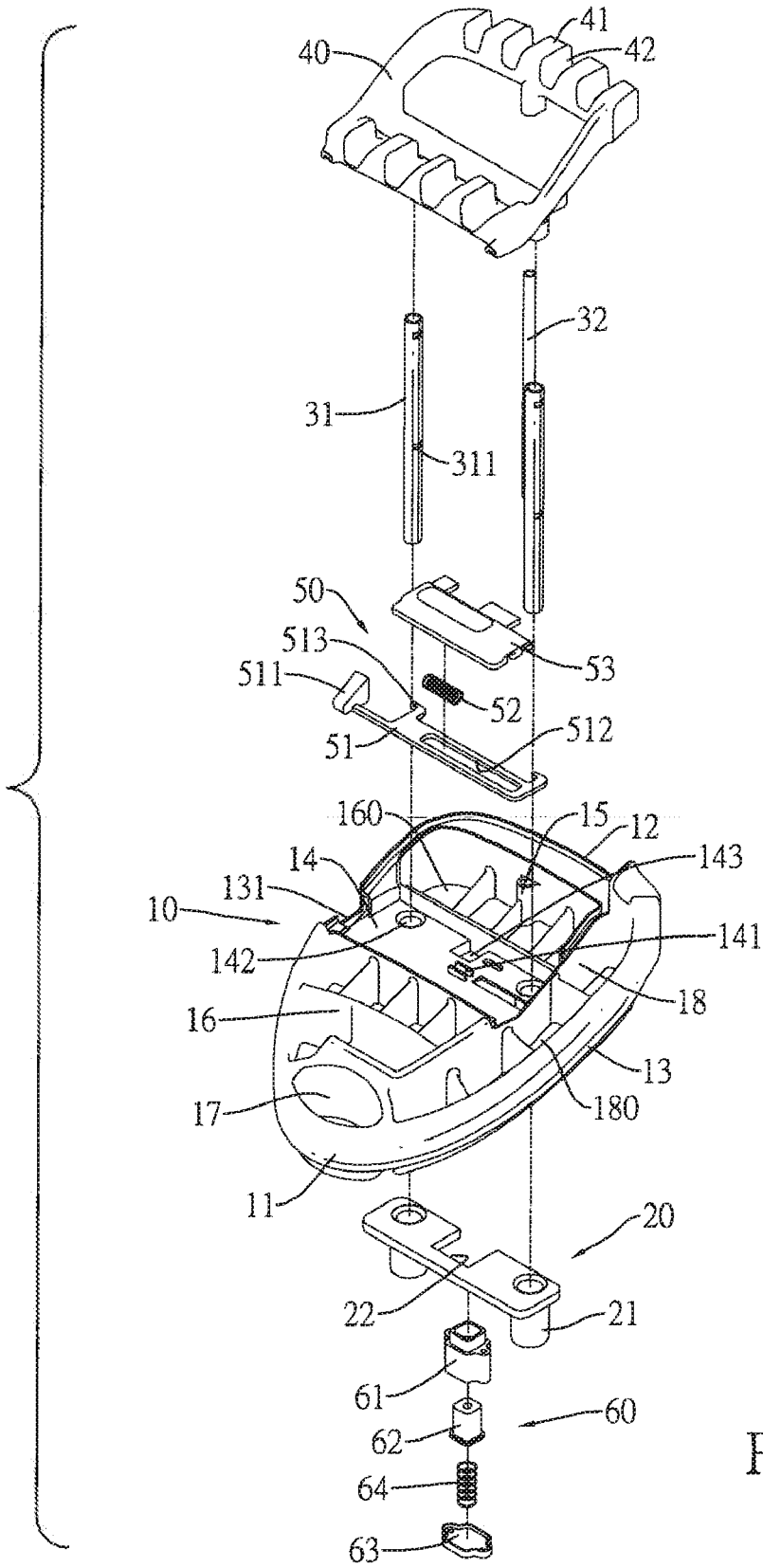
FIG. 3 is an exploded perspective view of the height adjustable top frame in FIG. 1.

With further reference to FIG. 3, the height adjustable top frame in accordance with the present invention comprises a base (10), a guiding bracket (20), at least one locking rod (31), at least one additional rod (32), a holding bracket (40), a locking mechanism (50) and a cushion mechanism (60).

The base (10) is shaped to incline, is mounted on the top of the golf bag (80) and has a top, a bottom, a front (11), a rear (12), a collar (13), a mounting step (14), at least one guiding tube (15), multiple transverse dividers (16), multiple transverse rows of multiple positioning holes (160), a putter hole (17), a longitudinal divider (18) and a longitudinal column of multiple positioning holes (180).

The rear (12) is formed higher than the front (11).

The collar (13) has a gap (131).

The mounting step (14) is formed between sides of the collar (13), corresponds to the gap (131) of the collar (13) and has a guiding protrusion (141), at least one mounting hole (142) and a notch (143). The guiding protrusion (141) protrudes toward the top of the base (10). The at least one mounting hole (142) and the notch (143) of the mounting step (14) are formed in the mounting step (14).

The at least one guiding tube (15) is formed perpendicularly on an inner surface of the collar (13).

The transverse dividers (16) are formed transversely between the inner surface of the collar (13) and the mounting step (14) and are located at different levels. The transverse rows of positioning holes (160) are defined between the inner surface of the collar (13), the mounting step (14) and the transverse dividers (16).

The putter hole (17) is defined between the inner surface of the collar (13) and a corresponding transverse divider (14) at the front (11) of the base (10) and holds the putter (70C) so that the putter (70C) can be quickly accessed and the putter (70C) in the putter hole (17) is not be blocked by other golf clubs (70).

The longitudinal divider (18) is formed longitudinally between the inner surface of the collar (13) adjacent to the transverse dividers (16) and the transverse rows of positioning holes (160). The longitudinal column of positioning holes (180) is defined between the inner surface of the collar (13)

and the longitudinal divider (18) and holds wood clubs so that the wood clubs can be quickly accessed.

The guiding bracket (20) is mounted on the bottom of the base (10) and has at least one mounting tube (21) and a through hole (22). The at least one mounting tube (21) is formed perpendicularly on the guiding bracket (20) and aligns with the at least one mounting hole (142) of the mounting step (14). The through hole (22) of the guiding bracket (20) is formed through the guiding bracket (20) and aligns with the notch (143) of the mounting step (14).

The at least one locking rod (31) is mounted through the at least one mounting hole (142) of the mounting step (14), may be mounted through the at least one mounting hole (21) of the guiding bracket (20) and has multiple notches (311). The notches (311) are formed separately in a side surface of the locking rod (31).

The at least one additional rod (32) is mounted through the at least one guiding tube (15) of the base (1I) and is parallel to the at least one locking rod (31).

The holding bracket (40) is mounted securely on upper ends of the locking and additional rods (31, 32) and has multiple crossbeams (41) and multiple positioning recesses (42). The crossbeams (41) respectively correspond to and are selectively mounted on the mounting step (14) and the transverse dividers (16) of the base (10). The positioning recesses (42) are formed in the crossbeams (41) and correspond respectively to the positioning holes (160) of the base (10).

Figure 4:
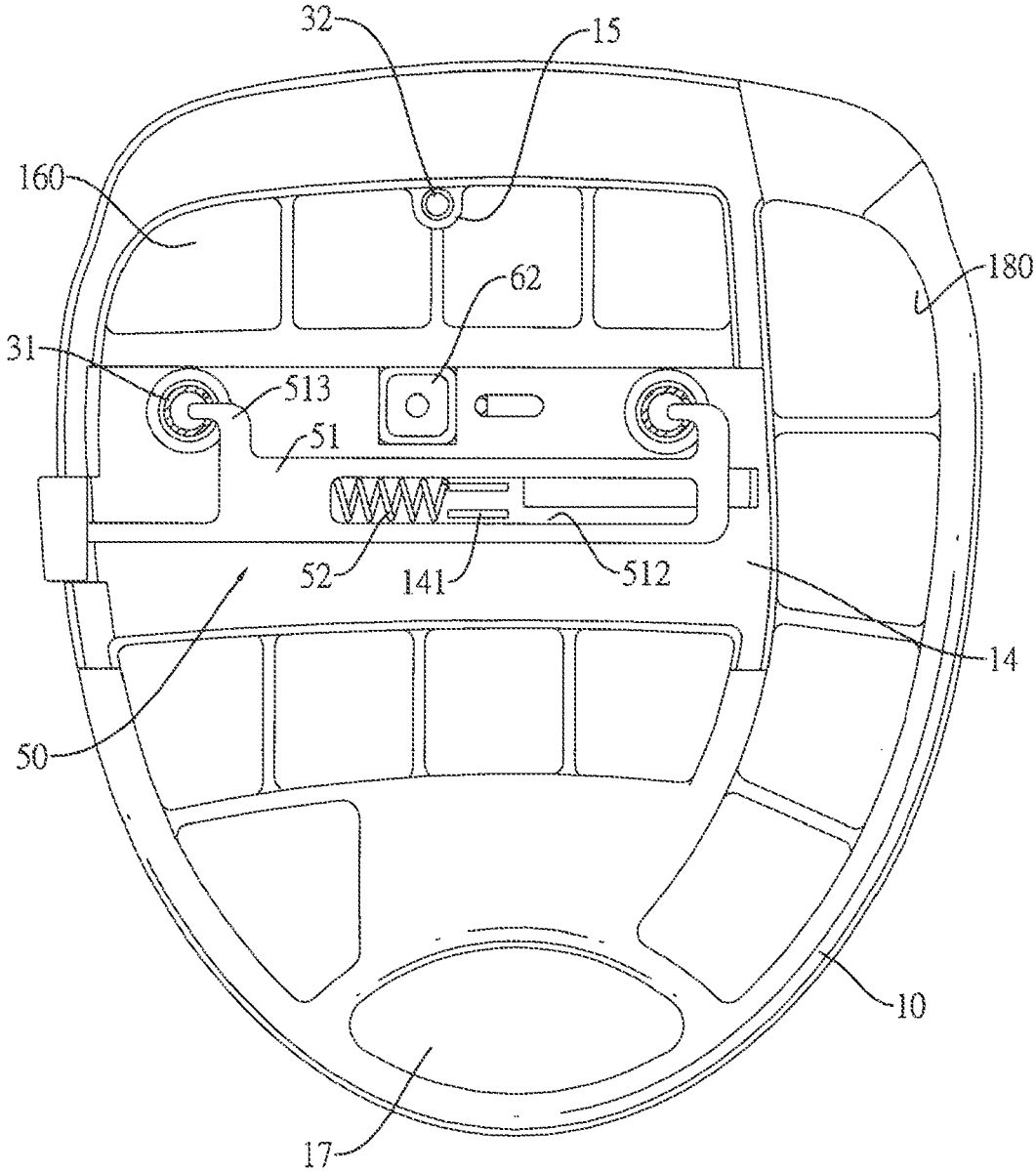
FIG. 4 is a top view of the height adjustable top frame in FIG. 1, showing a cover of a locking mechanism omitted.

With further reference to FIG. 4, the locking mechanism (50) is mounted between the base (10) and the holding bracket (40) and on the mounting step (14), selectively engages the at least one locking rod (31) and has a locking panel (51), a resilient component (52) and a cover (53).

The locking panel (51) is mounted on the mounting step (14) and has a pushing end (511), a guiding slot (512), an inner edge, and at least one locking protrusion (513). The pushing end (511) protrudes out of the gap (131) of the collar (13) of the base (10) to allow the locking panel (51) to be pushed. The guiding slot (512) is formed through the locking panel (51) and is mounted around the guiding protrusion (141) of the mounting step (14). The inner edge is defined around the guiding slot (512). The at least one locking protrusion (513) protrudes from an outer edge of the locking panel (51) and selectively engages one of the notches (311) of the at least one locking rod (31).

The resilient component (52) is mounted between and abuts the guiding protrusion (141) of the mounting step (14) and the inner edge of the locking panel (51) and pushes the locking panel (51) toward the gap (131) of the collar (13) of the base (10).

The cover (53) is mounted on the locking panel (51) and the resilient component (52) and is attached to the mounting step (14) of the base (10) to prevent the resilient component (52) from getting lost.

The cushion mechanism (60) is mounted through the through holes (143, 22) of the base (10) and the guiding bracket (20) and has a mounting tube (61), a stub (62), a cap (63) and a resilient component (64).

The mounting tube (61) is attached to the bottom of the base (10), may be attached to the guiding bracket (20), aligns with the through holes (143, 22) of the base (10) and the guiding bracket (20) and has a shoulder (611). The shoulder (611) is formed around an inner surface of the mounting tube (61).

The stub (62) is mounted slidably in the mounting tube (61) and has an upper end, and a flange (621). The upper end of the stub (62) protrudes out of the notch (143) of the base (10) and selectively abuts the holding bracket (40). The flange (621) is formed around a lower end of the stub (62) and selectively abuts the shoulder (611) of the mounting tube (61).

The cap (63) is attached to and covers a distal end of the mounting tube (61).

The resilient component (64) is mounted in the mounting tube (61) and abuts the cap (63) and stub (62) to push the stub (62) upwardly.

Figure 5:
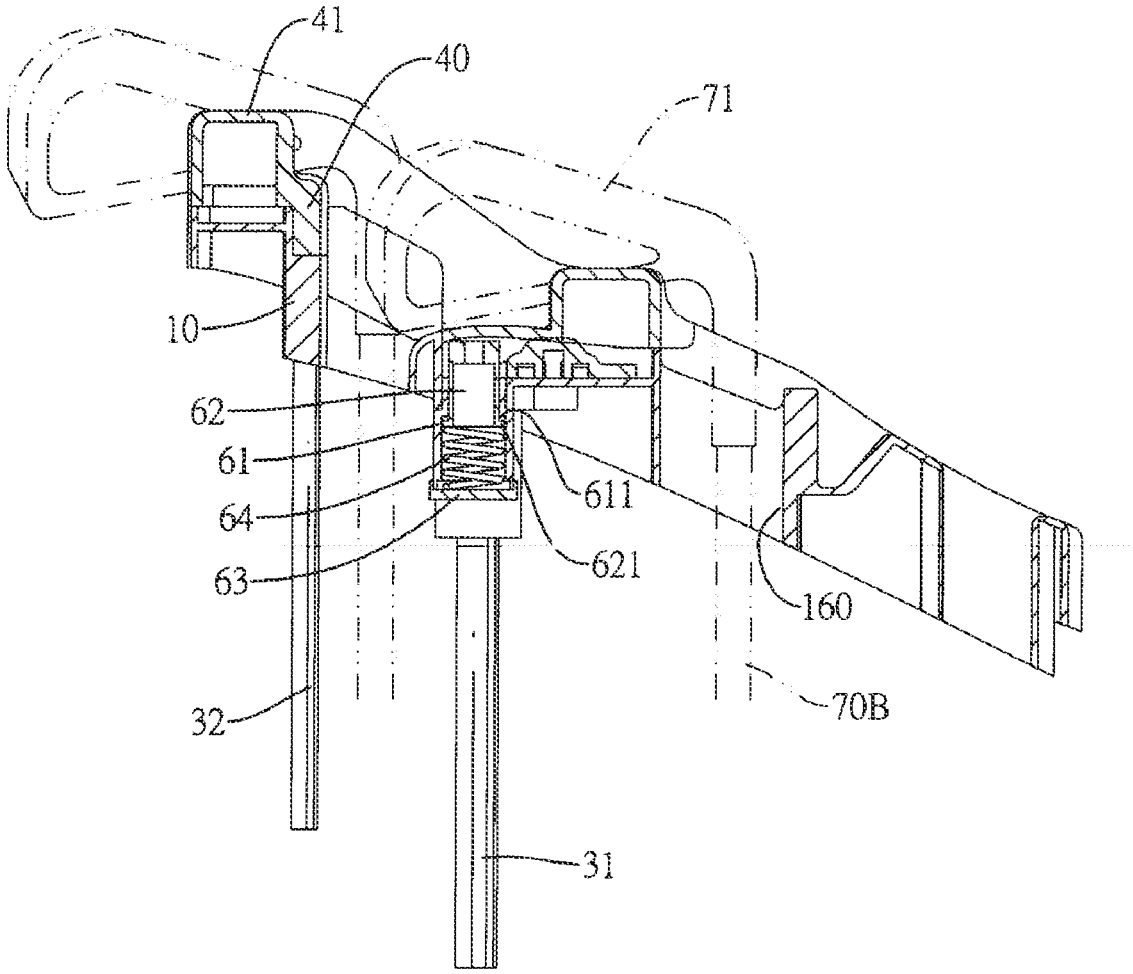
FIG. 5 is an operational side view in partial section of the height adjustable top frame in FIG. 1.
Figure 6:
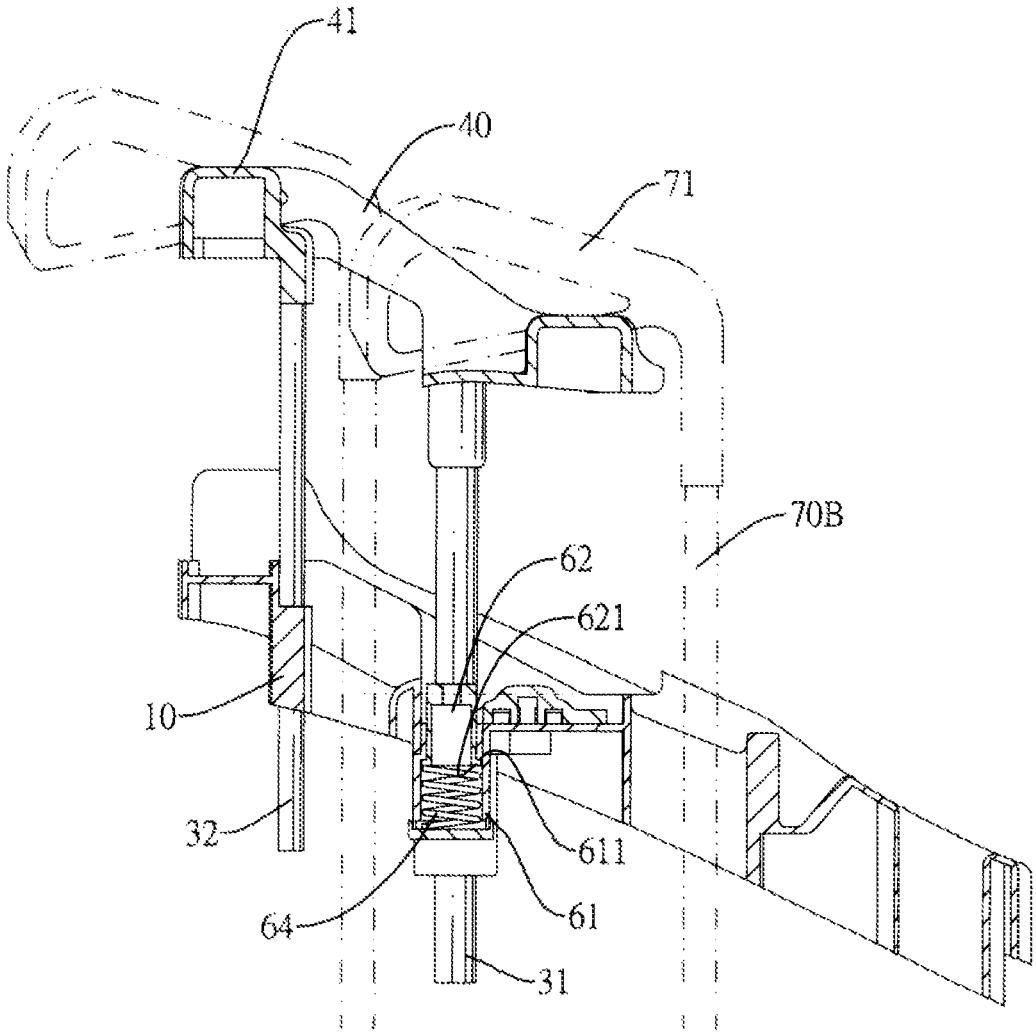
FIG. 6 is another operational side view in partial section of the height adjustable top frame in FIG. 1 holding heads of golf clubs.
Figure 7:
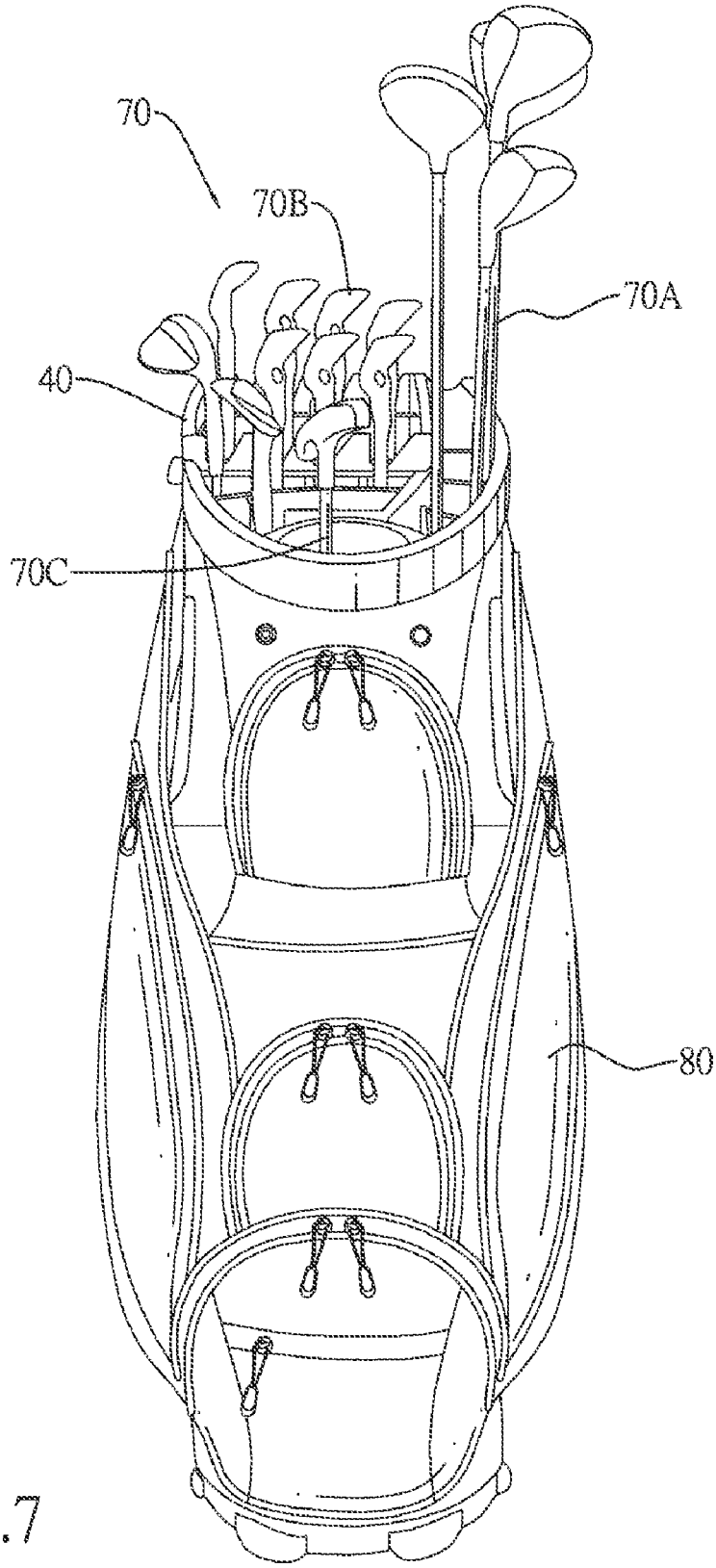
FIG. 7 is an operational perspective view of the height adjustable top frame in FIG. 1.
Figure 8:
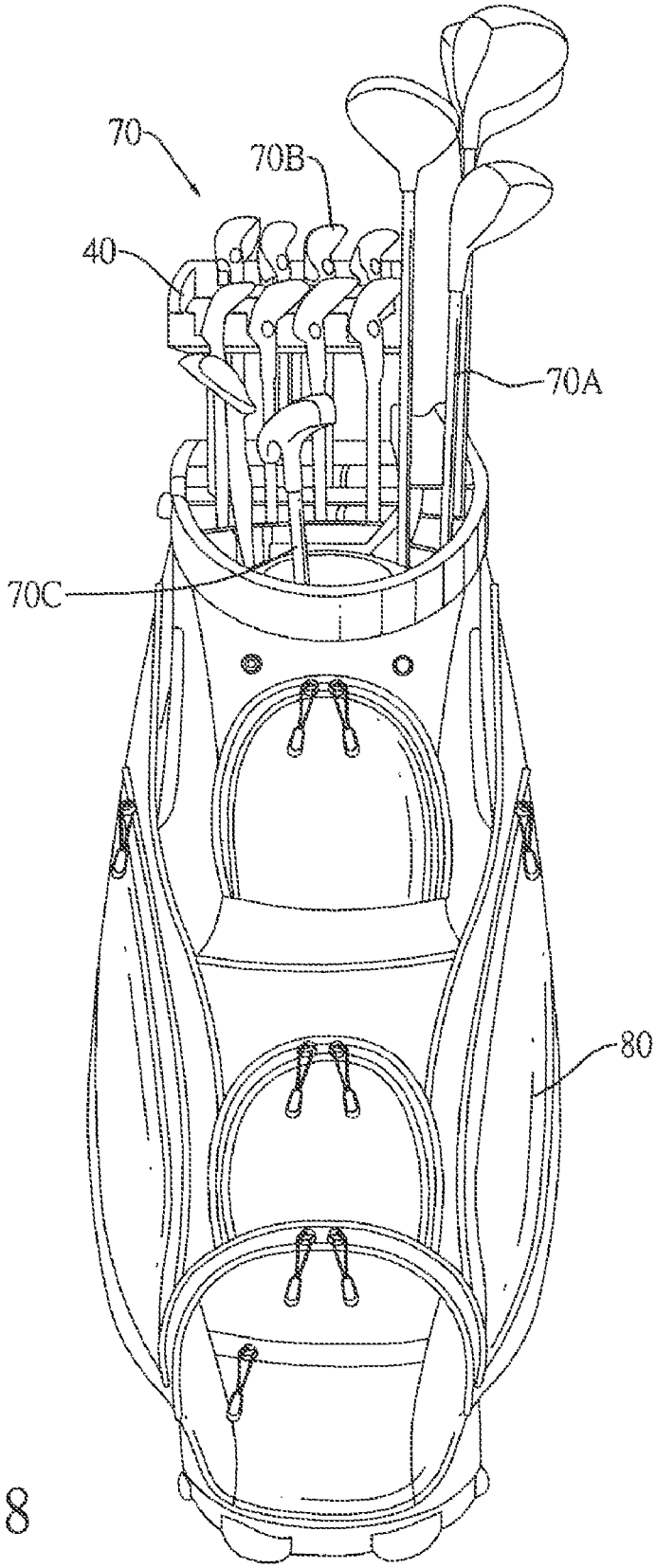
FIG. 8 is another operational perspective view of the height adjustable top frame in FIG. 1.

The height adjustable top frame for the golf bag as described has the following advantages. With further reference to FIGS. 3 and 5, when the holding bracket (40) is mounted on the base (10) and the at least one locking protrusion (513) of the locking panel (51) engages the notch (311) that is adjacent to the upper end of the at least one locking rod (31), short golf clubs (70), such as iron clubs (70B) of seven iron club to ten iron club, may be mounted respectively in the positioning holes (160) of the base (10) with their heads (71) resting on the positioning recess (42) of the holding bracket (40). With further reference to FIGS. 3 and 6 to 10, when there are long golf clubs (70), such as iron clubs (70B) of one iron club to six iron club, mounted respectively in the positioning holes (160) of the base (10), the pushing end (511) of the locking panel (51) is pushed to disengage the at least one locking protrusion (513) of the locking panel (51) from the notch (311) of the at least one locking rod (31), raise the holding bracket (40) and engage the at least one locking protrusion (513) of the locking panel (51) in the other notch (311) that is adjacent to a lower end of the at least one locking rod (31). Then the heads (71) of the long golf clubs (70) also rest on the positioning recess (42) of the holding bracket (40). The golf bag (80) with the height adjustable top frame as described does not have to be lengthened and the golf clubs (70) with different lengths are appropriately and stably mounted in the golf bag (80) without colliding or damaging each other.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A height adjustable top frame for a golf bag comprising:

a base shaped to incline and having a top;

a bottom;

a front;

a rear formed higher than the front;

a collar;

a mounting step formed between sides of the collar and having at least one mounting hole formed through the mounting step;

multiple transverse dividers formed transversely between an inner surface of the collar and the mounting step and respectively located at different levels; and multiple transverse rows of multiple positioning holes defined between the inner surface of the collar, the mounting step and the transverse dividers;

at least one locking rod mounted through the at least one mounting hole of the mounting step;

a holding bracket mounted securely on upper end of the at least one locking rod and having multiple crossbeams respectively corresponding to and selectively mounted on the mounting step and the transverse dividers of the base; and multiple positioning recesses formed in the crossbeams, and corresponding respectively to the positioning holes of the base; and a locking mechanism mounted between the base and the holding bracket and selectively engaging the at least one locking rod.

2. The top frame as claimed in claim 1, wherein the collar of the base further has a gap;

the mounting step of the base further has a guiding protrusion protruding toward the top of the base; and the at least one locking rod further has multiple notches formed separately in a side surface of the locking rod; and the locking mechanism is mounted on the mounting step and has a locking panel mounted on the mounting step and having a pushing end protruding out of the gap of the collar of the base;

a guiding slot formed through the locking panel and mounted around the guiding protrusion of the mounting step;

an inner edge defined around the guiding slot; and at least one locking protrusion protruding from an outer edge of the locking panel and selectively engaging one of the notches of the at least one locking rod;

a resilient component mounted between and abutting the guiding protrusion of the mounting step and the inner edge of the locking panel and pushing the locking panel toward the gap of the collar of the base; and a cover mounted on the locking panel and the resilient component and attached to the mounting step of the base.

3. The top frame as claimed in claim 2, wherein the mounting step of the base further has a notch; and the top frame further has a cushion mechanism mounted through the through hole of the base and having a mounting tube attached to the bottom of the base aligns with the through hole of the base and having a shoulder formed around an inner surface of the mounting tube;

a stub mounted slidably in the mounting tube and having an upper end protruding out of the through hole of the base and selectively abutting the holding bracket; and a flange formed around a lower end of the stub and selectively abutting the shoulder of the mounting tube;

a cap attached to and covering a distal end of the mounting tube; and a resilient component mounted in the mounting tube and abutting the cap and stub.

4. The top frame as claimed in claim 3, wherein the base further has at least one guiding tube formed perpendicularly on the inner surface of the collar the top frame further has a guiding bracket mounted on the bottom of the base and having at least one mounting tube formed perpendicularly on the guiding bracket and aligning with the at least one mounting hole of the mounting step; and a through hole formed through the guiding bracket and aligning with the notch of the mounting step; and at least one additional rod mounted through the at least one guiding tube of the base parallel to the at least one locking rod;

the at least one locking rod is mounted through the at least one mounting hole of the guiding bracket;

the holding bracket is mounted securely on upper end of the at least one additional rod; and the mounting tube of the cushion mechanism is attached to the guiding bracket and aligns with the through hole of the guiding bracket.

5. The top frame as claimed in claim 1, wherein the mounting step of the base further has a notch; and the top frame further has a cushion mechanism mounted through the through hole of the base and having a mounting tube attached to the bottom of the base aligns with the through hole of the base and having a shoulder formed around an inner surface of the mounting tube;

a stub mounted slidably in the mounting tube and having an upper end protruding out of the through hole of the base and selectively abutting the holding bracket; and a flange formed around a lower end of the stub and selectively abutting the shoulder of the mounting tube;

a cap attached to and covering a distal end of the mounting tube; and a resilient component mounted in the mounting tube and abutting the cap and stub.

6. The top frame as claimed in claim 5, wherein the base further has at least one guiding tube formed perpendicularly on the inner surface of the collar;

the top frame further has a guiding bracket mounted on the bottom of the base and having at least one mounting tube formed perpendicularly on the guiding bracket and aligning with the at least one mounting hole of the mounting step; and a through hole formed through the guiding bracket and aligning with the notch of the mounting step; and at least one additional rod mounted through the at least one guiding tube of the base being parallel to the at least one locking rod;

the at least one locking rod is mounted through the at least one mounting hole of the guiding bracket;

the holding bracket is mounted securely on upper end of the at least one additional rod; and the mounting tube of the cushion mechanism is attached to the guiding bracket and aligns with the through hole of the guiding bracket.

7. The top frame as claimed in claim 1, wherein the base further has a putter hole defined between the inner surface of the collar and a corresponding transverse divider at the front of the base.

8. The top frame as claimed in claim 1, wherein the base further has a longitudinal divider formed longitudinally between the inner surface of the collar adjacent to the transverse dividers and the transverse rows of positioning holes; and a longitudinal column of multiple positioning holes defined between the inner surface of the collar and the longitudinal divider.

* * * * *